US006763975B1

(12) United States Patent
Lesher

(10) Patent No.: US 6,763,975 B1
(45) Date of Patent: Jul. 20, 2004

(54) DECORATIVE CRAFT KIT AND METHOD OF USING

(76) Inventor: Karen L. Lesher, 9009 W Township Rd 36, Kansas, OH (US) 44841

( * ) Notice: Subject to any disclaimer, the term of this patent is extended or adjusted under 35 U.S.C. 154(b) by 11 days.

(21) Appl. No.: 10/342,455

(22) Filed: Jan. 14, 2003

(51) Int. Cl.[7] ..... B65D 35/22
(52) U.S. Cl. ..... 222/94; 222/107
(58) Field of Search ..... 222/94, 107

(56) References Cited

U.S. PATENT DOCUMENTS 3,100,063 A * 8/1963 Henriksen ..... 222/94
5,862,947 A * 1/1999 Wiegner et al. ..... 222/94

* cited by examiner

*Primary Examiner*—Philippe Derakshani

(57) ABSTRACT

A decorative craft kit and associated method of using the kit for use in decorating various objects with decorative resin is disclosed. The kit comprises a plurality of tube dispensers, a plurality of caps, and a plurality of applique tips. Each tube dispenser includes a main tubular body portion, a neck portion, a nozzle head portion, and a decorative resin wherein the decorative resin comprises water, acrylic polymer, calcium carbonate, ethylene glycol, mineral spirits and a coloring agent. Each cap of the plurality of caps is separately attached to the nozzle head portion of each corresponding tube dispenser. Each applique tip of the plurality of applique tips are separately attachable to the nozzle head portion of each corresponding tube dispenser. Another preferred embodiment of the kit consist essentially of a plurality of tube dispensers, a plurality of caps, a plurality of applique tips, a stylized logo, and a color indicia. The method of using the kit comprises the steps of aiming, allowing, identifying, obtaining, picking, putting, removing, screwing, selecting, squeezing, and un-screwing

19 Claims, 4 Drawing Sheets

DECORATIVE CRAFT KIT AND METHOD OF USING

FIELD OF THE INVENTION

The present invention relates art kits, more particularly, to a decorative craft kit and associated method of using for use in decorating a wide variety of objects with a decorative resin.

DESCRIPTION OF THE PRIOR ART

A wide variety of craft kits is currently available on the commercial market and an even larger number of these types of devices are known in the art of craft kits, for example, the confectioner's decorating device disclosed by Setecka in U.S. Pat. No. 2,945,458; the pressurized container having a plurality of selectively attachable nozzles disclosed by Schultz and Armstrong in U.S. Pat. No. 3,191,809; the set of devices for fabricating colored plastic pictures or products and method of fabricating colored plastic pictures or products with use thereof disclosed by Kuranaga in U.S. Pat. No. 5,044,957; the tube dispenser with sponge applicator disclosed by Koptis in U.S. Pat. No. 5,577,851; the ergonomeric dispenser for viscous materials disclosed by Benedict et al. in U.S. Pat. No. 5,588,560; the fluid applicator disclosed by Phillips in U.S. Pat. No. 6,095,705; the instruments for producing edible colored indicia on food substrates and medicaments disclosed by Naor and Michael in U.S. Pat. No. 6,299,374; and the applicator tube disclosed by Loeb in U.S. Pat. No. D414,688.

While all of the above-described devices fulfill their respective, particular objectives and requirements, the aforementioned patents do not describe a decoration craft kit having a plurality of tube dispensers, a plurality of caps, and a plurality of applique tips, in which, each tube dispenser includes a main tubular body portion, a neck portion, a nozzle head portion, and a decorative resin wherein the decorative resin comprises water, acrylic polymer, calcium carbonate, ethylene glycol, mineral spirits and a coloring agent. This combination of elements would specifically match the user's particular individual needs of making it possible to decorate a wide variety of objects with the decorative resin. The above-described patents make no provision for a decoration craft kit having a plurality of tube dispensers, a plurality of caps, and a plurality of applique tips, in which, each tube dispenser includes a main tubular body portion, a neck portion, a nozzle head portion, and a decorative resin wherein the decorative resin comprises water, acrylic polymer, calcium carbonate, ethylene glycol, mineral spirits and a coloring agent.

Therefore, a need exists for a new and improved decoration craft kit having a plurality of tube dispensers, a plurality of caps, and a plurality of applique tips, in which, each tube dispenser includes a main tubular body portion, a neck portion, a nozzle head portion, and a decorative resin wherein the decorative resin comprises water, acrylic polymer, calcium carbonate, ethylene glycol, mineral spirits and a coloring agent. In this respect, the decoration craft kit according to the present invention substantially departs from the conventional concepts and designs of the prior art, and in doing so provides an apparatus primarily developed for the purpose of providing means for decorating a wide variety of objects with decorative resin.

SUMMARY OF THE INVENTION

The present kit and method of using, according to the principles of the present invention, overcomes the shortcomings of the prior art by providing a decoration craft kit and method of using is disclosed. The kit comprises a plurality of tube dispensers, a plurality of caps, and a plurality of applique tips. Each tube dispenser includes a main tubular body portion, a neck portion, a nozzle head portion, and a decorative resin wherein the decorative resin comprises water, acrylic polymer, calcium carbonate, ethylene glycol, mineral spirits and a coloring agent. Each cap of the plurality of caps is separately attached to the nozzle head portion of each corresponding tube dispenser. Each applique tip of the plurality of applique tips is separately attachable to the nozzle head portion of each corresponding tube dispenser. Another preferred embodiment of the kit consist essentially of a plurality of tube dispensers, a plurality of caps, a plurality of applique tips, a stylized logo, and a color indicia. The method of using the kit comprises the steps of aiming, allowing, identifying, obtaining, picking, putting, removing, screwing, selecting, squeezing, and un-screwing In view of the foregoing disadvantages inherent in the known type decorative craft kits now present in the prior art, the present invention provides an improved decoration craft kit, which will be described subsequently in great detail, is to provide a new and improved decoration craft kit which is not anticipated, rendered obvious, suggested, or even implied by the prior art, either alone or in any combination thereof.

To attain this, the present invention essentially comprises a plurality of tube dispensers, a plurality of caps, and a plurality of applique tips. Each tube dispenser includes a main tubular body portion, a neck portion, a nozzle head portion, and a decorative resin wherein the decorative resin comprises water, acrylic polymer, calcium carbonate, ethylene glycol, mineral spirits and a coloring agent. Each cap of the plurality of caps is separately attached to the nozzle head portion of each corresponding tube dispenser. Each applique tip of the plurality of applique tips are separately attachable to the nozzle head portion of each corresponding tube dispenser.

There has thus been outlined, rather broadly, the more important features of the invention in order that the detailed description thereof that follows may be better understood, and in order that the present contribution of the art may be better appreciated.

The invention may also include a stylized logo affixed onto each tube dispenser. There are of course, additional features of the invention that will be described hereinafter and which will form the subject matter of the claims attached.

Numerous objects, features and advantages of the present invention will be readily apparent to those of ordinary skill in the art upon reading of the following detailed description of presently preferred, but nonetheless illustrative, embodiments of the present invention when taken in conjunction with the accompany drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved decoration craft kit that has all the advantages of the prior art decoration craft kit and none of the disadvantages.

It is another object of the present invention to provide a new and improved decoration craft kit that may be easily and efficiently manufactured and marketed.

An even further object of the present invention is to provide a new and improved decoration craft kit that has a low cost of manufacture with regard to both materials and labor, and which accordingly is then susceptible of low prices of sale to the consuming public, thereby making such multipurpose storage unit and system economically available to the buying public.

Still another object of the present invention is to provide a new decoration craft kit that provides in the apparatuses and methods of the prior art some of the advantages thererof, while simultaneously overcoming some of the disadvantages normally associated therewith.

Even still another object of the present invention is to provide a decoration craft kit having a plurality of tube dispensers, a plurality of caps, and a plurality of applique tips, in which, each tube dispenser includes a main tubular body portion, a neck portion, a nozzle head portion, and a decorative resin wherein the decorative resin comprises water, acrylic polymer, calcium carbonate, ethylene glycol, mineral spirits and a coloring agent. This combination of elements makes it possible to decorate a wide variety of objects with the decorative resin Lastly, it is an object of the present invention to provide a new and improved method of using comprising the steps of aiming, allowing, identifying, obtaining, picking, putting, removing, screwing, selecting, squeezing, and un-screwing Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and description matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DETAILED DESCRIPTION OF THE PREFERRED EMBODIMENT

Figure 1:
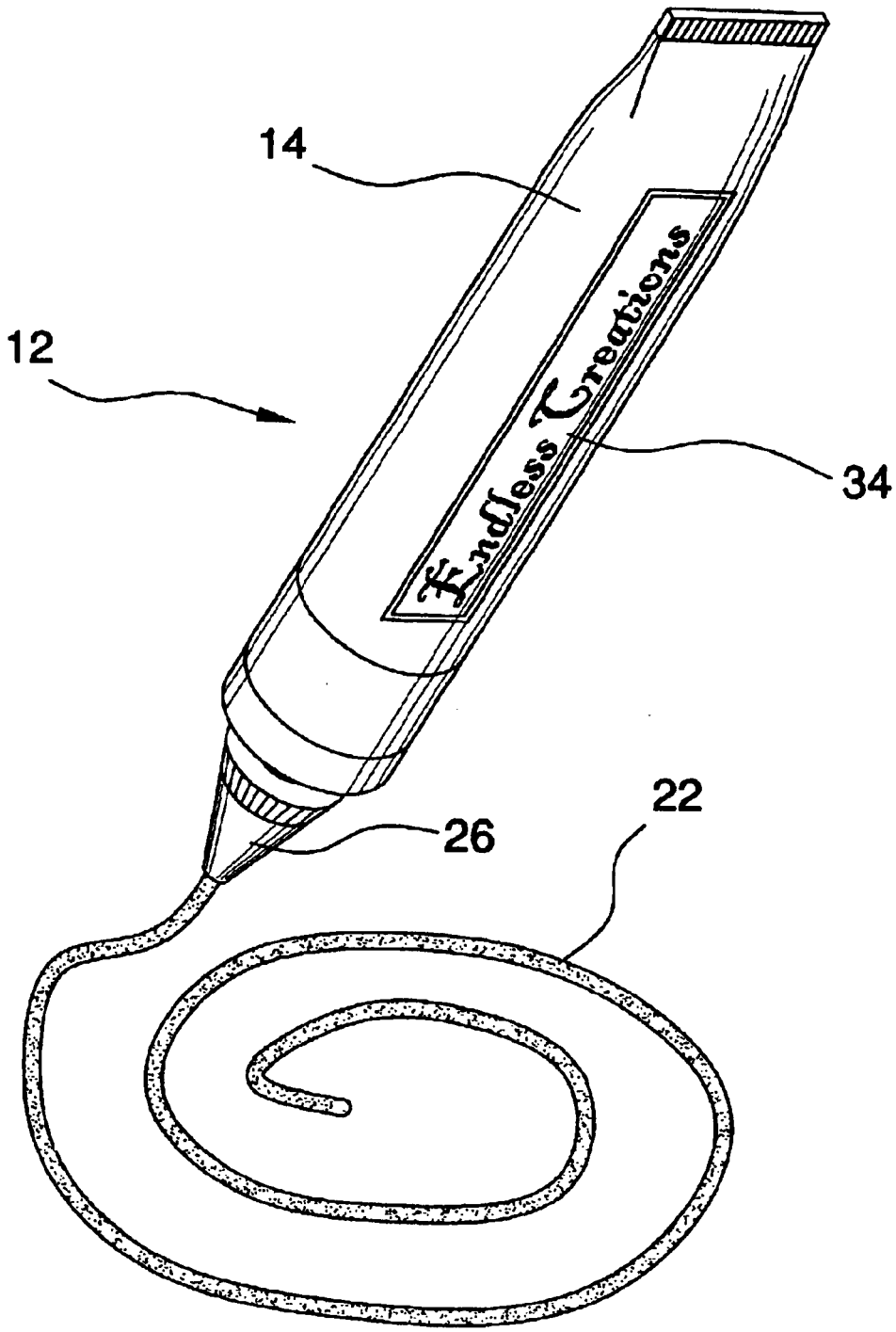
FIG. 1 is a perspective view of one of the tube dispensers in a preferred embodiment of the decoration craft kit constructed in accordance with the principles of the present invention.
Figure 2:
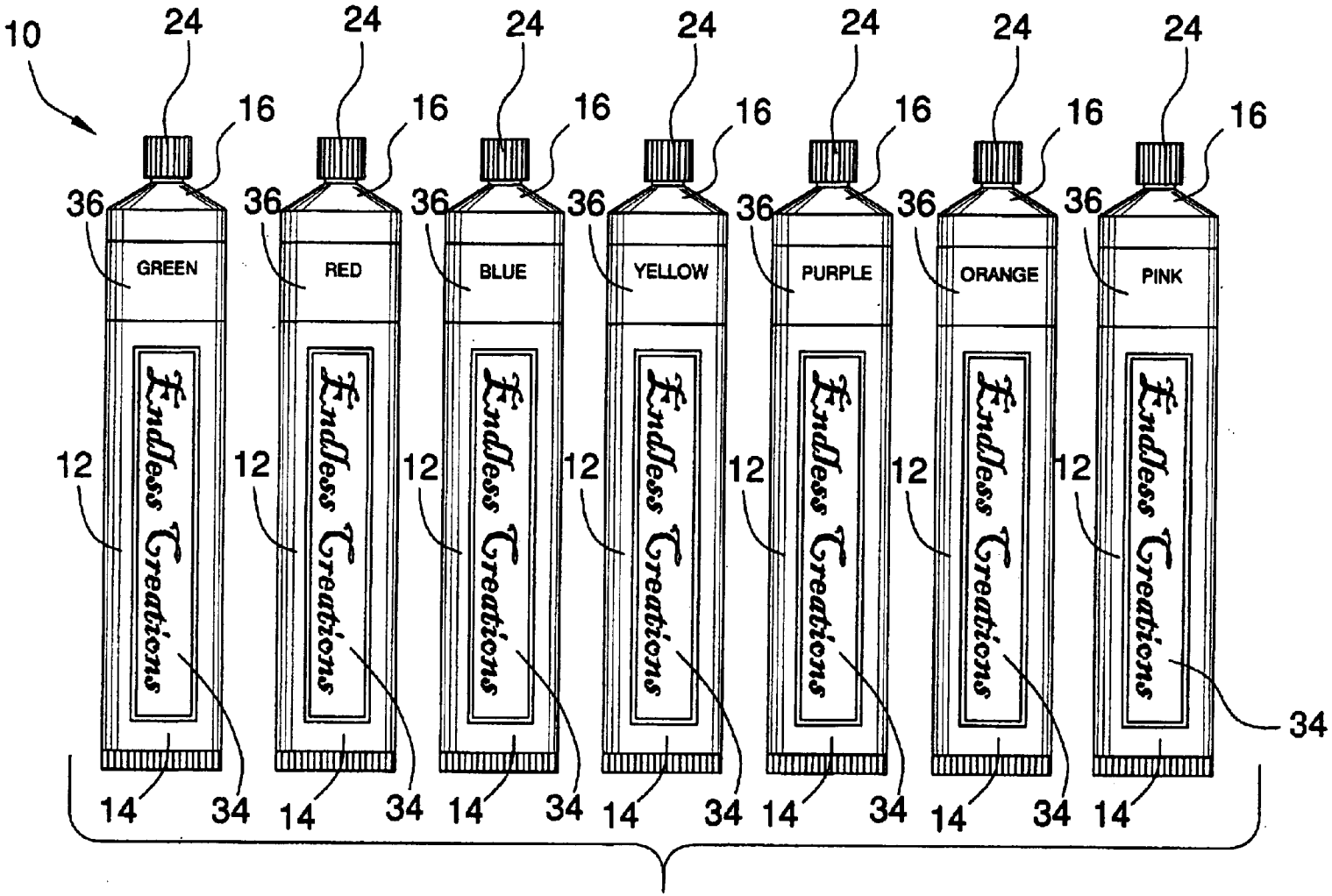
FIG. 2 is a front plan view of a preferred embodiment of the decoration craft kit of the present invention.
Figure 3:
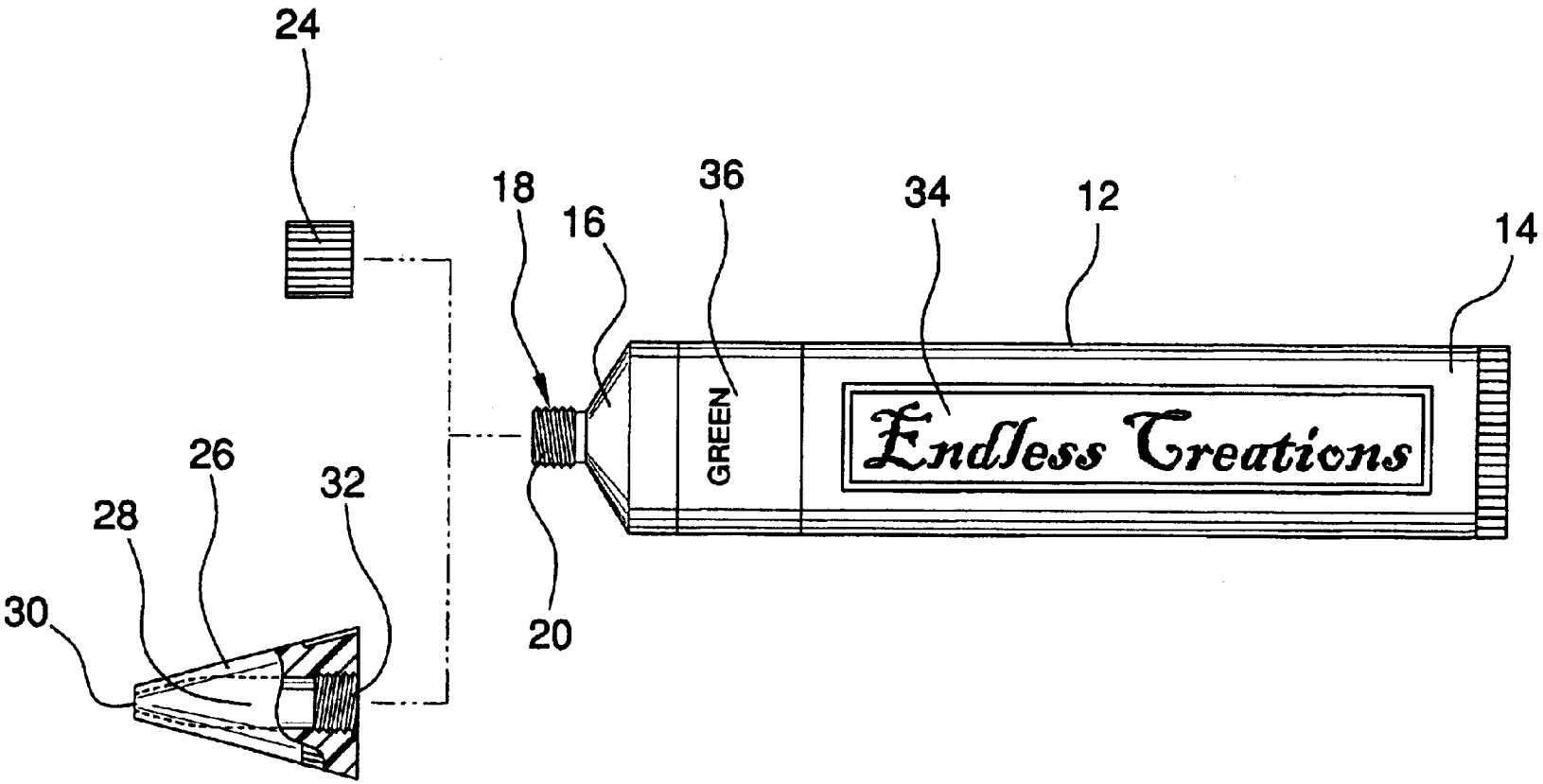
FIG. 3 is a front plan view of one tube dispenser in a preferred embodiment of the decoration craft kit of the present invention.
Figure 4:
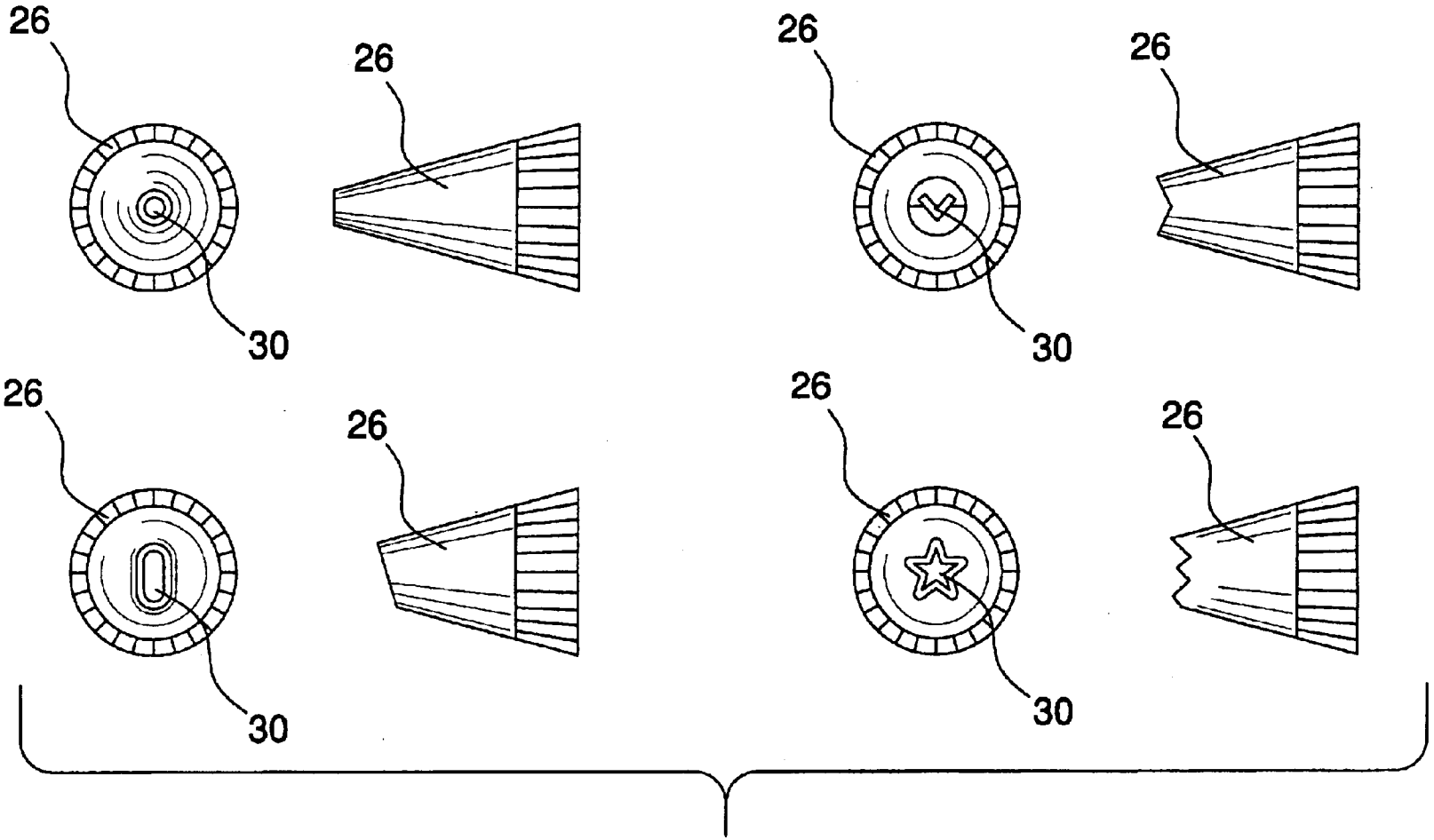
FIG. 4 is a front plan and side view of a set of applique tips of a preferred embodiment of the decoration craft kit of the present invention.

Referring now to the drawings, and in particular FIG. 1 to 4 thereof, one preferred embodiment of the present invention is shown and generally designated by the reference numeral 10. One preferred embodiment of a decoration craft kit 10 comprising: a plurality of tube dispensers 12, a plurality of caps 24, and a plurality of applique tips 26. Each tube dispenser 12 of the plurality of tube dispensers 12, includes: a main tubular body portion 14, a neck portion 16, a nozzle head portion 18, and a decorative resin 22. The main tubular body portion 14 has an lower end and an upper end, in which the lower end of the main tubular body portion 14 is sealed. The neck portion 16 extends inwardly from the upper end of the main tubular body portion 14. The nozzle head portion 18 is attached to the neck portion 16, in which the nozzle head portion 18 having an exterior wall and an interior wall, the exterior wall of the nozzle having an exterior spiral thread 20, wherein the interior wall defining a hole traversing through the nozzle head portion 18. The main tubular body portion 14, the neck portion 16 and the nozzle head portion 18 defining a hollow interior zone within each tube dispenser 12, wherein the hole of the nozzle head portion 18 is in fluid communications with the hollow interior zone within each tube dispenser 12. The decorative resin 22 is contained within the hollow interior zone of each tube dispenser 12, wherein the decorative resin 22 comprising: water, acrylic polymer, calcium carbonate, ethylene glycol, mineral spirits and a coloring agent. Each cap 24 of the plurality of caps 24 is separately attached to the nozzle head portion 18 of each corresponding tube dispenser 12. Each applique tip 26 of the plurality of applique tips 26 includes a truncated cone and an interior spiral thread 32. The truncated cone has an outer wall and an inner wall, in which the inner wall defining a hollow inner aperture 28. The hollow inner aperture 28 traversing from the distal to the proximate ends of each applique tip 26, wherein the inner wall defining a geometrically shaped exit orifice 30 at the distal end of the truncated cone, wherein the exit orifice 30 is in fluid communications with the hollow inner aperture 28. The interior spiral thread 32 is attached to the inner wall of the truncated cone at the proximate end of each applique tip 26, wherein the interior spiral thread 32 of each applique tip 26 is attachable to the exterior spiral thread 20 of the noble head portion 18 of anyone tube dispenser 12 of the plurality of tube dispensers 12.

An optional a stylized logo 34 may be attached to each tube dispenser 12.

An optional color indicia 36 may be attached to each tube dispenser 12.

The number of tube dispensers 12 may comprise any number of tube dispensers 12. One preferred configuration is that the number of tube dispensers 12 comprises at least four tube dispensers 12. Another preferred configuration is that the number of tube dispensers 12 comprises at least eight tube dispensers 12.

The coloring agent may be any coloring agent. One preferred configuration of the coloring agent is that it is selected from the group consisting of green, red, blue, yellow, purple, orange, and pink.

The geometrically shaped exit orifice 30 may be any known geometric shape. The geometrically shaped exit orifice 30 may be selected from the group consisting of a circular shaped exit orifice 30, a V-shaped exit orifice 30, an oval shaped exit orifice 30, a pentagram shaped exit orifice 30, a hexagram shaped exit orifice 30, a square shaped exit orifice 30, a rectangular shaped exit orifice 30, a elliptical shaped exit orifice 30, a triangular shaped exit orifice 30, a pentagonal shaped exit orifice 30, and a hexagonal shaped exit orifice 30.

Another preferred embodiment of the decoration craft kit 10 consisting essentially of: a plurality of tube dispensers 12, each tube dispenser 12 including: a main tubular body portion 14 having an lower end and an upper end, the lower end of the main tubular body portion 14 is sealed; a neck portion 16 extending inwardly from the upper end of the main tubular body portion 14; a nozzle head portion 18 attached to the neck portion 16, the nozzle head portion 18 having an exterior wall and an interior wall, the exterior wall of the nozzle having an exterior spiral thread 20, the interior wall defining a hole traversing through the nozzle head portion 18, wherein the main tubular body portion 14, the neck portion 16 and the nozzle head portion 18 defining a hollow interior zone within each tube dispenser 12, wherein the hole of the nozzle head portion 18 is in fluid communications with the hollow interior zone within each tube dispenser 12; and a decorative resin 22 contained within the hollow interior zone of each tube dispenser 12, the decorative resin 22 comprising: water, acrylic polymer, calcium carbonate, ethylene glycol, mineral spirits and a coloring agent; a plurality of caps 24, each cap 24 is separately attached to the nozzle head portion 18 of each corresponding tube dispenser 12; a plurality of applique tips 26, each applique tip 26 including: a truncated cone having an outer wall and an inner wall, the inner wall defining a hollow inner aperture 28, the hollow inner aperture 28 traversing from the distal to the proximate ends of each applique tip 26, wherein the inner wall defining a geometrically shaped exit orifice 30 at the distal end of the truncated cone, wherein the exit orifice 30 is in fluid communications with the hollow inner aperture 28; and an interior spiral thread 32 attached to the inner wall of the truncated cone at the proximate end of each applique tip 26, wherein the interior spiral thread 32 of each applique tip 26 is attachable to the exterior spiral thread 20 of the nozzle head portion 18 of anyone tube dispenser 12 of the plurality of tube dispensers 12; a stylized logo 34 attached to each tube dispenser 12; and a color indicia 36 attached to each tube dispenser 12.

One preferred embodiment of a method of using a decoration craft kit 10, in which the method comprising the steps of aiming, allowing, identifying, obtaining, picking, putting, removing, screwing, selecting, squeezing, and unscrewing. The obtaining step comprises obtaining the kit 10 consisting essentially of: a plurality of tube dispensers 12, each tube dispenser 12 including: a main tubular body portion 14 having an lower end and an upper end, the lower end of the main tubular body portion 14 is sealed; a neck portion 16 extending inwardly from the upper end of the main tubular body portion 14; a nozzle head portion 18 attached to the neck portion 16, the nozzle head portion 18 having an exterior wall and an interior wall, the exterior wall of the nozzle having an exterior spiral thread 20, the interior wall defining a hole traversing through the nozzle head portion 18, wherein the main tubular body portion 14, the neck portion 16 and the nozzle head portion 18 defining a hollow interior zone within each tube dispenser 12, wherein the hole of the nozzle head portion 18 is in fluid communications with the hollow interior zone within each tube dispenser 12; and a decorative resin 22 contained within the hollow interior zone of each tube dispenser 12, the decorative resin 22 comprising: water, acrylic polymer, calcium carbonate, ethylene glycol, mineral spirits and a coloring agent; a plurality of caps 24, each cap 24 is separately attached to the nozzle head portion 18 of each corresponding tube dispenser 12; a plurality of applique tips 26, each applique tip 26 including: a truncated cone having an outer wall and an inner wall, the inner wall defining a hollow inner aperture 28, the hollow inner aperture 28 traversing from the distal to the proximate ends of each applique tip 26, wherein the inner wall defining a geometrically shaped exit orifice 30 at the distal end of the truncated cone, wherein the exit orifice 30 is in fluid communications with the hollow inner aperture 28; and an interior spiral thread 32 attached to the inner wall of the truncated cone at the proximate end of each applique tip 26, wherein the interior spiral thread 32 of each applique tip 26 is attachable to the exterior spiral thread 20 of the nozzle head portion 18 of anyone tube dispenser 12 of the plurality of tube dispensers 12; a stylized logo 34 attached to each tube dispenser 12; and a color indicia 36 attached to each tube dispenser 12. The identifying step comprises identifying an object to be decorated. The picking step comprises picking out one tube dispenser 12 of the plurality of tube dispensers 12. The removing step comprises removing the cap 24 attached to the picked out tube dispenser 12 of the plurality of tube dispensers 12. The selecting step comprises selecting out one applique tip 26 of the plurality of applique tips 26. The screwing step comprises screwing on the selected out applique tip 26 onto the nozzle head portion 18 of the picked out tube dispenser 12. The aiming step comprises aiming the distal end of the selected out applique tip 26 screwed onto the nozzle head portion 18 of the picked out tube dispenser 12 at the identified object. The squeezing step comprises squeezing the lower end of the main tubular body portion 14 of the picked out tube dispenser 12 when the distal end of the selected out applique tip 26 screwed onto the nozzle head portion 18 of the picked out tube dispenser 12 is aimed at the identified object. The allowing step comprises allowing the resin 22 within the hollow interior zone of the picked out tube dispenser 12 to flow onto the identified objects when the distal end of the selected out applique tip 26 screwed onto the nozzle head portion 18 of the picked out tube dispenser 12 is aimed at the identified object and when the lower end of the main tubular body portion 14 of the picked out tube dispenser 12 is squeezed. The unscrewing step comprises un-screwing on the selected out applique tip 26 from the nozzle head portion 18 of the picked out tube dispenser 12, the un-screwing step performed subsequent to the allowing step. The putting step comprises putting back the cap 24 onto the picked out tube dispenser 12 of the plurality of tube dispensers 12, the putting step performed subsequent to the un-screwing step.

As to the manner of usage and operation of the present invention, the same should be apparent from the above description. Accordingly, no further discussion relating to the manner of usage and operation will be provided.

While a preferred embodiment of the decoration craft kit has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Throughout this specification, unless the context requires otherwise, the word "comprise" or variations such as "comprises" or "comprising" or the term "includes" or variations, thereof, or the term "having" or variations, thereof will be understood to imply the inclusion of a stated element or integer or group of elements or integers but not the exclusion of any other element or integer or group of elements or integers. In this regard, in construing the claim scope, an embodiment where one or more features is added to any of the claims is to be regarded as within the scope of the invention given that the essential features of the invention as claimed are included in such an embodiment.

Those skilled in the art will appreciate that the invention described herein is susceptible to variations and modifications other than those specifically described. It is to be understood that the invention includes all such variations and modifications which fall within its spirit and scope. The invention also includes all of the steps, features, compositions and compounds referred to or indicated in this specification, individually or collectively, and any and all combinations of any two or more of said steps or features.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A decoration craft kit comprising:

a plurality of tube dispensers, each tube dispenser including:

a main tubular body portion having an lower end and an upper end, the lower end of said main tubular body portion is sealed;

a neck portion extending inwardly from the upper end of the main tubular body portion;

a nozzle head portion attached to the neck portion, said nozzle head portion having an exterior wall and an interior wall, said exterior wall of said nozzle head portion having an exterior spiral thread, said interior wall defining a hole traversing through said nozzle head portion, wherein said main tubular body portion, said neck portion and said nozzle head portion defining a hollow interior zone within each tube dispenser, wherein said hole of said nozzle head portion is in fluid communications with said hollow interior zone within each tube dispenser; and a decorative resin contained within said hollow interior zone of each tube dispenser, said decorative resin comprising: water, acrylic polymer, calcium carbonate, ethylene glycol, mineral spirits and a coloring agent;

a plurality of caps, each cap is separately attached to said nozzle head portion of each corresponding tube dispenser; and a plurality of applique tips, each applique tip including:

a truncated cone having an outer wall and an inner wall, said inner wall defining a hollow inner aperture, the hollow inner aperture traversing from the distal to the proximate ends of each applique tip, wherein said inner wall defining a geometrically shaped exit orifice at the distal end of said truncated cone, wherein said exit orifice is in fluid communications with said hollow inner aperture; and an interior spiral thread attached to the inner wall of the truncated cone at the proximate end of each applique tip, wherein said interior spiral thread of each applique tip is attachable to the exterior spiral thread of the nozzle head portion of anyone tube dispenser of said plurality of tube dispensers.

2. The kit of claim 1 further comprising a stylized logo attached to each tube dispenser.

3. The kit of claim 1 further comprising a color indicia attached to each tube dispenser.

4. The kit of claim 1 wherein said plurality of tube dispensers comprises at least four tube dispensers.

5. The kit of claim 1 wherein said plurality of tube dispensers comprises at least eight tube dispensers.

6. The kit of claim 1 wherein said coloring agent is selected from the group consisting of green, red, blue, yellow, purple, orange, and pink.

7. The kit of claim 1 wherein said inner wall defining a circular shaped exit orifice.

8. The kit of claim 1 wherein said inner wall defining a V-shaped exit orifice.

9. The kit of claim 1 wherein said inner wall defining an oval shaped exit orifice.

10. The kit of claim 1 wherein said inner wall defining a pentagram shaped exit orifice.

11. The kit of claim 1 wherein said inner wall defining a hexagram shaped exit orifice.

12. The kit of claim 1 wherein said inner wall defining a square shaped exit orifice.

13. The kit of claim 1 wherein said inner wall defining a rectangular shaped exit orifice.

14. The kit of claim 1 wherein said inner wall defining an elliptical shaped exit orifice.

15. The kit of claim 1 wherein said inner wall defining a triangular shaped exit orifice.

16. The kit of claim 1 wherein said inner wall defining a pentagonal shaped exit orifice.

17. The kit of claim 1 wherein said inner wall defining a hexagonal shaped exit orifice.

18. A decoration craft kit consisting essentially of:

a plurality of tube dispensers, each tube dispenser including:

a main tubular body portion having an lower end and an upper end, the lower end of said main tubular body portion is sealed;

a neck portion extending inwardly from the upper end of the main tubular body portion;

a nozzle head portion attached to the neck portion, said nozzle head portion having an exterior wall and an interior wall, said exterior wall of said nozzle head portion having an exterior spiral thread, said interior wall defining a hole traversing through said nozzle head portion, wherein said main tubular body portion, said neck portion and said nozzle head portion defining a hollow interior zone within each tube dispenser, wherein said hole of said nozzle head portion is in fluid communications with said hollow interior zone within each tube dispenser; and a decorative resin contained within said hollow interior zone of each tube dispenser, said decorative resin comprising: water, acrylic polymer, calcium carbonate, ethylene glycol, mineral spirits and a coloring agent;

a plurality of caps, each cap is separately attached to said nozzle head portion of each corresponding tube dispenser;

a plurality of applique tips, each applique tip including:

a truncated cone having an outer wall and an inner wall, said inner wall defining a hollow inner aperture, the hollow inner aperture traversing from the distal to the proximate ends of each applique tip, wherein said inner wall defining a geometrically shaped exit orifice at the distal end of said truncated cone, wherein said exit orifice is in fluid communications with said hollow inner aperture; and an interior spiral thread attached to the inner wall of the truncated cone at the proximate end of each applique tip, wherein said interior spiral thread of each applique tip is attachable to the exterior spiral thread of the nozzle head portion of anyone tube dispenser of said plurality of tube dispensers;

a stylized logo attached to each tube dispenser; and a color indicia attached to each tube dispenser.

19. A method of using a decoration craft kit, said method comprising the steps of: obtaining the kit consisting essentially of:

a plurality of tube dispensers, each tube dispenser including:

a main tubular body portion having an lower end and an upper end, the lower end of said main tubular body portion is sealed;

a neck portion extending inwardly from the upper end of the main tubular body portion;

a nozzle head portion attached to the neck portion, said nozzle head portion having an exterior wall and an interior wall, said exterior wall of said nozzle head portion having an exterior spiral thread, said interior wall defining a hole traversing through said nozzle head portion, wherein said main tubular body portion, said neck portion and said nozzle head portion defining a hollow interior zone within each tube dispenser, wherein said hole of said nozzle head portion is in fluid communications with said hollow interior zone within each tube dispenser; and a decorative resin contained within said hollow interior zone of each tube dispenser, said decorative resin comprising: water, acrylic polymer, calcium carbonate, ethylene glycol, mineral spirits and a coloring agent;

a plurality of caps, each cap is separately attached to said nozzle head portion of each corresponding tube dispenser;

a plurality of applique tips, each applique tip including:

a truncated cone having an outer wall and an inner wall, said inner wall defining a hollow inner aperture, the hollow inner aperture traversing from the distal to the proximate ends of each applique tip, wherein said inner wall defining a geometrically shaped exit orifice at the distal end of said truncated cone, wherein said exit orifice is in fluid communications with said hollow inner aperture; and an interior spiral thread attached to the inner wall of the truncated cone at the proximate end of each applique tip, wherein said interior spiral thread of each applique tip is attachable to the exterior spiral thread of the nozzle head portion of anyone tube dispenser of said plurality of tube dispensers;

a stylized logo attached to each tube dispenser; and a color indicia attached to each tube dispenser.

identifying an object to be decorated;

picking out one tube dispenser of the plurality of tube dispensers;

removing the cap attached to the picked out tube dispenser of the plurality of tube dispensers;

selecting out one applique tip of the plurality of applique tips;

screwing on the selected out applique tip onto the nozzle head portion of the picked out tube dispenser;

aiming the distal end of the selected out applique tip screwed onto the nozzle head portion of the picked out tube dispenser at the identified object;

squeezing the lower end of the main tubular body portion of the picked out tube dispenser when the distal end of the selected out applique tip screwed onto the nozzle head portion of the picked out tube dispenser is aimed at the identified object;

allowing the resin within the hollow interior zone of the picked out tube dispenser to flow onto the identified objects when the distal end of the selected out applique tip screwed onto the nozzle head portion of the picked out tube dispenser is aimed at the identified object and when the lower end of the main tubular body portion of the picked out tube dispenser is squeezed;

un-screwing on the selected out applique tip from the nozzle head portion of the picked out tube dispenser, said un-screwing step performed subsequent to said allowing step; and putting back the cap onto the picked out tube dispenser of the plurality of tube dispensers, said putting step performed subsequent to said un-screwing step.

* * * * *